US011518647B2

(12) United States Patent
Kurose

(10) Patent No.: US 11,518,647 B2
(45) Date of Patent: Dec. 6, 2022

(54) ELEVATOR AND ELEVATOR LANDING GUIDANCE DEVICE

(71) Applicant: Mitsubishi Electric Corporation, Tokyo (JP)

(72) Inventor: Kohei Kurose, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 384 days.

(21) Appl. No.: 16/638,146

(22) PCT Filed: Sep. 25, 2017

(86) PCT No.: PCT/JP2017/034527

§ 371 (c)(1),
(2) Date: Feb. 11, 2020

(87) PCT Pub. No.: WO2019/058551

PCT Pub. Date: Mar. 28, 2019

(65) Prior Publication Data

US 2021/0371237 A1 Dec. 2, 2021

(51) Int. Cl.
*B66B 3/00* (2006.01)
*B66B 1/46* (2006.01)

(52) U.S. Cl.
CPC ..... *B66B 3/006* (2013.01); *B66B 1/468* (2013.01); *B66B 2201/463* (2013.01); *B66B 2201/4615* (2013.01)

(58) Field of Classification Search
CPC ..... B66B 3/006; B66B 1/34; G10L 13/00
See application file for complete search history.

(56) References Cited

U.S. PATENT DOCUMENTS 4,545,248 A 10/1985 Kitada et al.
4,655,324 A * 4/1987 Meguerdichian ..... B66B 1/468 187/380

(Continued)

FOREIGN PATENT DOCUMENTS

JP 55-74971 A 6/1980
JP S60-000312 A 1/1985

(Continued)

OTHER PUBLICATIONS

Office Action dated Aug. 11, 2021, in corresponding Korean patent Application No. 10-2020-7007760, 9 pages.

(Continued)

*Primary Examiner* — Daniel Abebe
(74) *Attorney, Agent, or Firm* — Xsensus LLP

(57) ABSTRACT

Provided is an elevator landing guidance device including: a hall operation panel (2) provided on each of floors, which is configured to output a guide sound (A) for informing a position of the hall operation panel (2) and accept input of landing call registration; and a guide sound generator (3), which is provided to a landing of each of the floors for each of elevator machines, and which is configured to output a guide sound (B) for informing a position of the landing. When the landing call registration is input to the hall operation panel (2), the guide sound (B) is output from the guide sound generator (3) installed so as to correspond to one of the elevator machines, which is assigned to the landing call registration.

10 Claims, 6 Drawing Sheets

(56) References Cited

U.S. PATENT DOCUMENTS

| | | | | |
|---|---|---|---|---|
| 2007/0181379 | A1* | 8/2007 | Flynn | B66B 1/468 187/382 |
| 2007/0240943 | A1* | 10/2007 | Gerstenkorn | B66B 3/00 187/382 |
| 2008/0264730 | A1* | 10/2008 | Blackaby | B66B 1/468 187/380 |
| 2017/0183198 | A1* | 6/2017 | Lee | B66B 1/468 |

FOREIGN PATENT DOCUMENTS

| | | | |
|---|---|---|---|
| JP | 08-268656 | A | 10/1996 |
| JP | 2007-537962 | A | 12/2007 |
| JP | 2015-214416 | A | 12/2015 |
| SG | 10201503740 | R | 12/2015 |
| WO | 2016/185527 | A1 | 11/2016 |

OTHER PUBLICATIONS

International Search Report and Written Opinion dated Nov. 14, 2017 for PCT/JP2017/034527 filed on Sep. 25, 2017, 11 pages including English Translation of the International Search Report.

* cited by examiner

ELEVATOR AND ELEVATOR LANDING GUIDANCE DEVICE

CROSS-REFERENCE TO RELATED APPLICATION

The present application is based on PCT filing PCT/JP2017/034527, filed Sep. 25, 2017, the entire contents of which are incorporated herein by reference.

TECHNICAL FIELD

The present invention relates to an elevator and an elevator landing guidance device, more particularly, to an elevator and an elevator landing guidance device, which are configured to guide a user of the elevator to a landing.

BACKGROUND ART

There has been proposed a device configured to guide a user of an elevator to a landing with use of an audio message (see, for example, Patent Literature 1 and Patent Literature 2).

In a related-art device described in Patent Literature 1, a speaker device is arranged for each elevator machine. When one elevator machine is assigned to a floor on which a service request has been made, the speaker device corresponding to the assigned elevator machine is selected. Then, an audio message indicating arrival of a car of the assigned elevator machine is output from the selected speaker device.

In a related-art device described in Patent Literature 2, a disabled person notification button is provided to a destination floor registration device installed in a landing. When the disabled person notification button is operated by a user, an audio guidance in consideration of disabled people is given. The audio guidance, for example, "PRIORITY PASSENGER WILL BOARD. WHILE WAITING TO BOARD, STAND AWAY FROM THE DOOR." is intended to inform and invite priority boarding of a user.

CITATION LIST

Patent Literature

[PTL 1] JP H08-268656 A
[PTL 2] JP 2015-214416 A

SUMMARY OF INVENTION

Technical Problem

However, the related art has the following problems. In the related-art devices described in Patent Literature 1 and Patent Literature 2, the guidance is given with use of the audio message. Thus, effective guidance information can be provided to a user who can understand an audio content. Meanwhile, there arises a problem in that some users cannot understand an audio guidance due to, for example, a linguistic difference in some cases. Further, when multiple-language guidance service is to be provided, an announcement audio source is required for each language and each content. Thus, there arises a problem in that a data amount is increased. Further, in the audio guidance, there arises the following problem. When a landing is crowded, a voice of the audio guidance is mixed with a voice of a passenger and is hard to hear and distinguish in some cases.

The present invention has been made to solve the problems described above, and has an object to provide an elevator landing guidance device and an elevator, with which a user can be smoothly guided to a landing for a corresponding elevator machine even when the landing is crowded regardless of a linguistic difference.

Solution to Problem

According to one embodiment of the present invention, there is provided an elevator landing guidance device, including: a hall operation panel, which is provided on each of floors, and which is configured to accept input of landing call registration; and a guide sound generator, which is provided to a landing of each of the floors for each of elevator machines, and which is configured to output a first guide sound for informing a position of the landing, wherein, when the landing call registration is input to the hall operation panel, the guide sound generator corresponding to one of the elevator machines, which is assigned to the landing call registration, outputs the first guide sound.

Advantageous Effects of Invention

With the elevator landing guidance device according to one embodiment of the present invention, a user is guided to a landing with use of the first guide sound. As a result, even when the landing is crowded, the user can be smoothly guided to the landing for a corresponding elevator machine regardless of a linguistic difference.

DESCRIPTION OF EMBODIMENTS

First Embodiment

An elevator landing guidance device according to a first embodiment of the present invention is configured to guide a user of an elevator to a hall operation panel and a landing for an elevator machine assigned to the user. The elevator landing guidance device according to the first embodiment guides the user not with use of an audio message but with use of a guide sound other than an audio message. Thus, an effective guide can be provided to all users including users of other languages and visually impaired people. As examples of the guide sound, for example, an electronic sound, a buzzer sound, and a melody are given.

Figure 1:
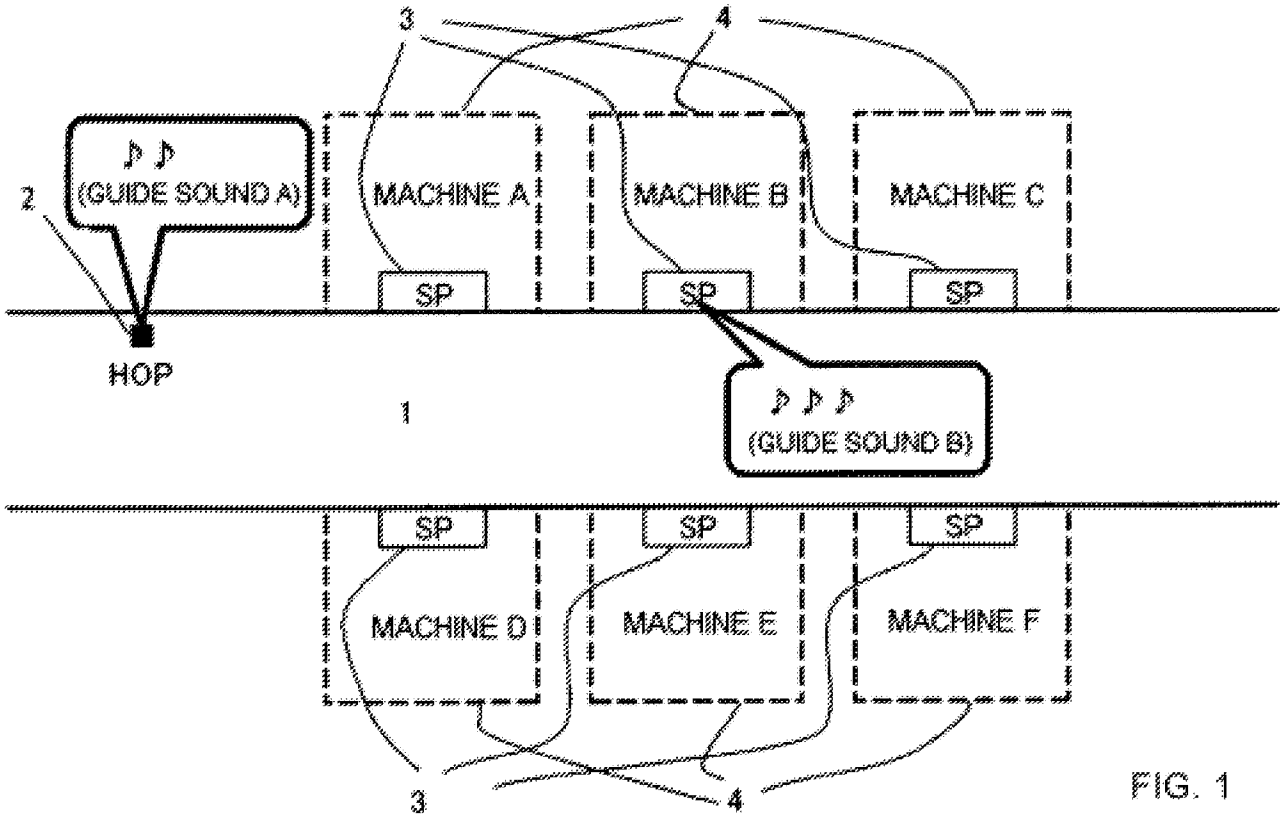
FIG. 1 is a plan view for illustrating a configuration of an elevator landing guidance device according to a first embodiment of the present invention.
Figure 2:
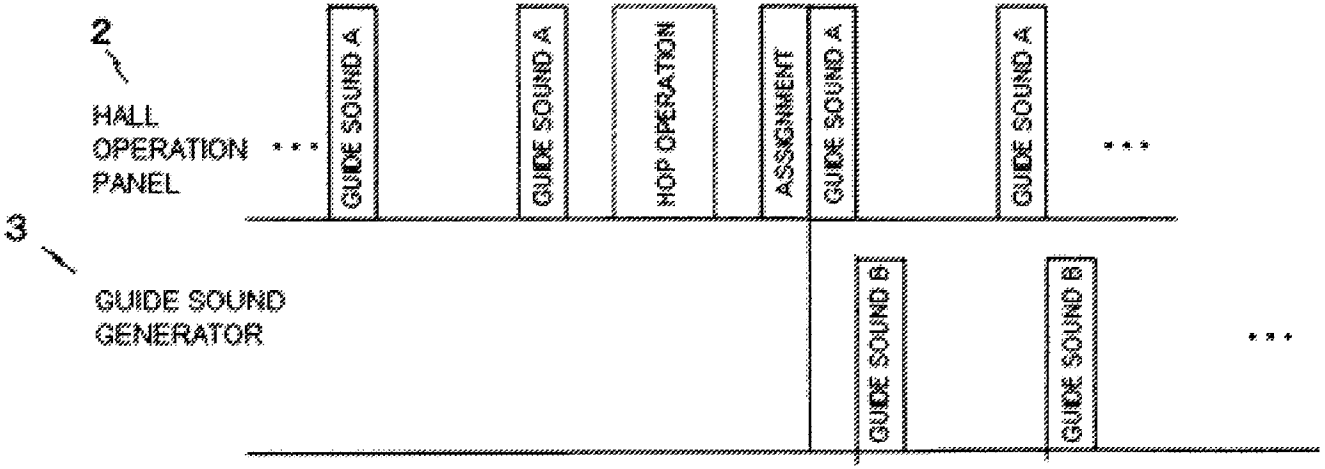
FIG. 2 is a timing chart for showing output timings of a guide sound A and a guide sound B in the elevator landing guidance device according to the first embodiment of the present invention.
Figure 3:
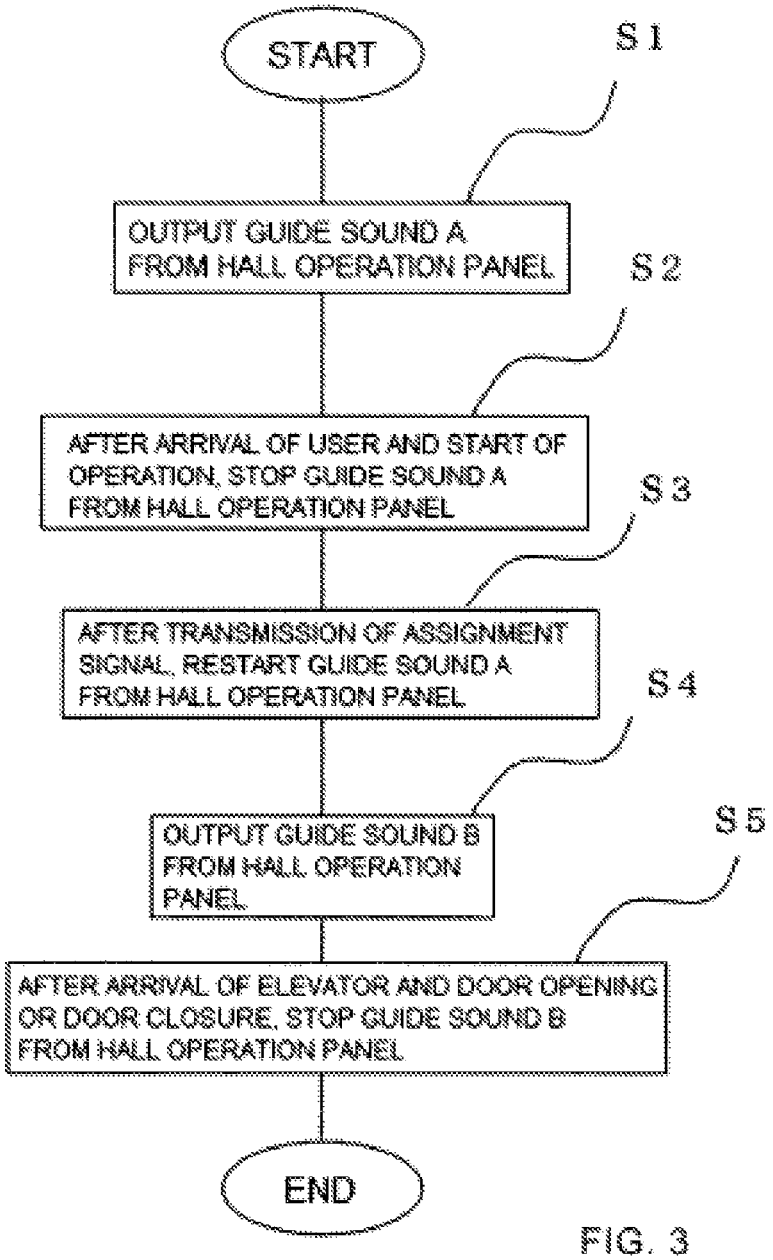
FIG. 3 is a flowchart for illustrating flow of processing performed by the elevator landing guidance device according to the first embodiment of the present invention.
Figure 4:
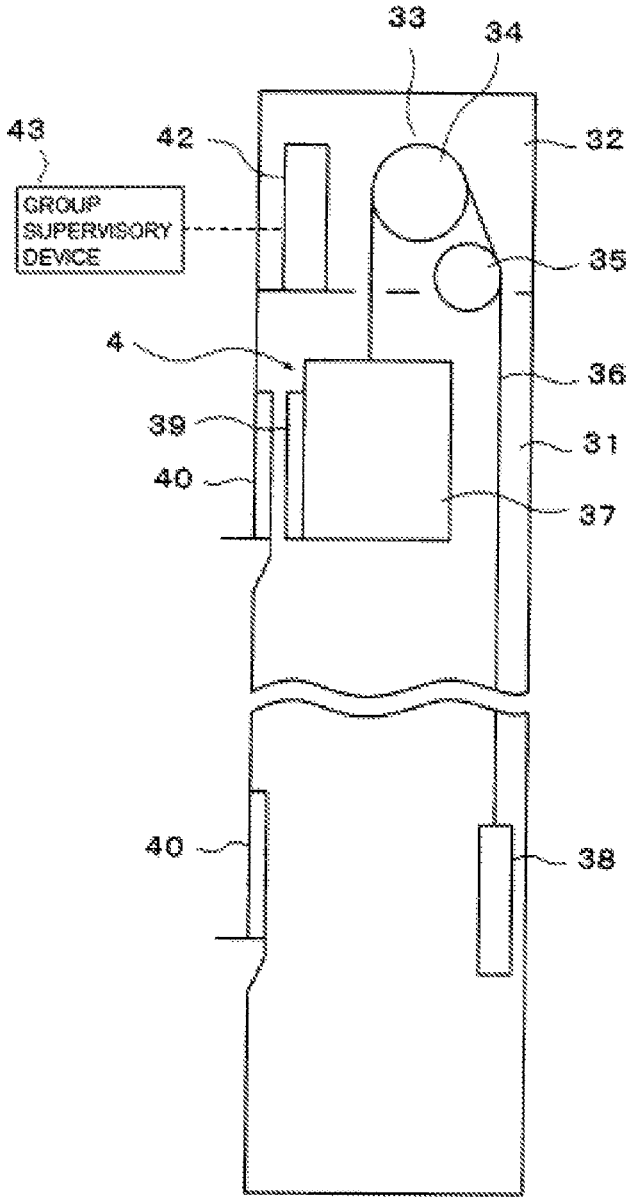
FIG. 4 is a configuration diagram for illustrating one elevator machine installed in an elevator according to the first embodiment of the present invention.

An elevator and the elevator landing guidance device according to the first embodiment are now described with reference to FIG. 1 to FIG. 4. FIG. 1 is a plan view for illustrating configurations of the elevator and the elevator landing guidance device according to the first embodiment. FIG. 2 is a timing chart for showing output timings of a guide sound A and a guide sound B in the elevator landing guidance device according to the first embodiment. FIG. 3 is a flowchart for illustrating flow of processing performed by the elevator landing guidance device according to the first embodiment. FIG. 4 is a configuration diagram for illustrating an elevator machine included in the elevator according to the first embodiment.

As illustrated in FIG. 1, in the elevator according to the first embodiment, a total of six elevator machines 4 are installed in such a manner that three elevator machines 4 are installed on each side of a through passage for forming a landing 1. In FIG. 1, the elevator machines 4 described above are denoted as a machine A, a machine B, a machine C, a machine D, a machine E, and a machine F. In the elevator according to the first embodiment, the elevator machines 4 described above are under group supervisory control. The number of elevator machines is not limited to six, and may be a suitable number.

FIG. 4 is an illustration of a configuration of one of the plurality of elevator machines 4 included in the elevator according to the first embodiment. As illustrated in FIG. 4, for each elevator machine 4, a hoistway 31 is provided. In an upper part of the hoistway 31, a machine room 32 is installed. In the machine room 32, a hoisting machine 33 is installed. The hoisting machine 33 includes a drive sheave 34 and a deflector sheave 35. A hoisting rope 36 is wound around the drive sheave 34 and the deflector sheave 35. A car 37 is connected to one end of the hoisting rope 36. Further, a counterweight 38 is connected to another end of the hoisting rope 36. The car 37 and the counterweight 38 are raised and lowered by the hoisting machine 33 in the hoistway 31. A car door 39 is provided to the car 37. A landing door 40 is provided to the landing 1 on each floor.

A car controller 42 configured to control travel of the elevator machine 4 is provided in the machine room 32. The car controller 42 is provided to each of the elevator machines 4 on a one-to-one basis. One group supervisory device 43 is connected to each car controller 42. The group supervisory device 43 performs group supervision of travel of the six elevator machines. When a hall operation panel 2 described later is operated by a user of the elevator, the group supervisory device 43 performs landing call registration in accordance with the operation. Hereinafter, the operation performed by the user is referred to as "landing call registration request". Further, the group supervisory device 43 selects and assigns one elevator machine 4 as a response to the landing call registration request. The car controller 42 corresponding to the assigned elevator machine 4 controls the elevator machine 4 to travel in accordance with a command from the group supervisory device 43.

Next, a configuration of the elevator landing guidance device according to the first embodiment is described. The elevator landing guidance device includes the hall operation panel 2 and a guide sound generator 3.

The hall operation panel 2 is installed on each floor. The hall operation panel 2 is installed, for example, at an entrance of the landing 1, as illustrated in FIG. 1. More specifically, the hall operation panel 2 is installed so as to be separate from the elevator machine located at a distal end, specifically, from the machine A in the example of FIG. 1 by a preset distance. The hall operation panel 2 outputs the guide sound A so as to inform the user of a position of the hall operation panel 2. When the user operates the hall operation panel 2 to input a destination floor, the output of the guide sound A is temporarily stopped. Further, when a preset condition is met, the hall operation panel 2 restarts the output of the guide sound A. As examples of the preset condition, for example, completion of assignment of the elevator machine in accordance with the destination floor input by the user or elapse of a predetermined time period are given. An output operation for the guide sound A, which is performed by the hall operation panel 2, is controlled by the group supervisory device 43. On an operation panel of the hall operation panel 2, for example, numeric keys from "0" to "9" are arranged or floor buttons for each floor are arranged. The user operates the numeric keys or the floor buttons to input the destination floor to make a landing call registration request. The hall operation panel 2 transmits the landing call registration request to the group supervisory device 43.

The guide sound generator 3 is installed for each of the elevator machines 4 in the landing 1, as illustrated in FIG. 1. The guide sound generator 3 outputs the guide sound B so as to inform the user of a position of a landing for each of the elevator machines. The guide sound B may be the same sound as the guide sound A. Desirably, however, the guide sound B is set as a sound different from the guide sound A. The guide sound generator 3 is installed so as to be located within a preset region from a position of the landing door 40 so that the guide sound B is output toward the landing for each of the elevator machines 4. The guide sound generator 3 is installed on, for example, a landing wall to which the landing door 40 is provided. More specifically, the guide sound generator 3 may be arranged on the landing wall adjacent to the landing door 40 or may be arranged on the landing wall above the landing door 40. Alternatively, the guide sound generator 3 may be embedded under a floor surface immediately in front of the landing door 40. When the group supervisory device 43 assigns one elevator machine 4 to the landing call registration request made by the user, the guide sound generator 3 corresponding to the assigned elevator machine 4 outputs the guide sound B. With the guide sound B, the user can easily recognize the assigned elevator machine 4. Further, when the user moves toward the guide sound generator 3, which is a sound source of the guide sound B, the user can reach the landing for the assigned elevator machine 4. The guide sound generator 3 is controlled by the car controller 42.

Figure 5:
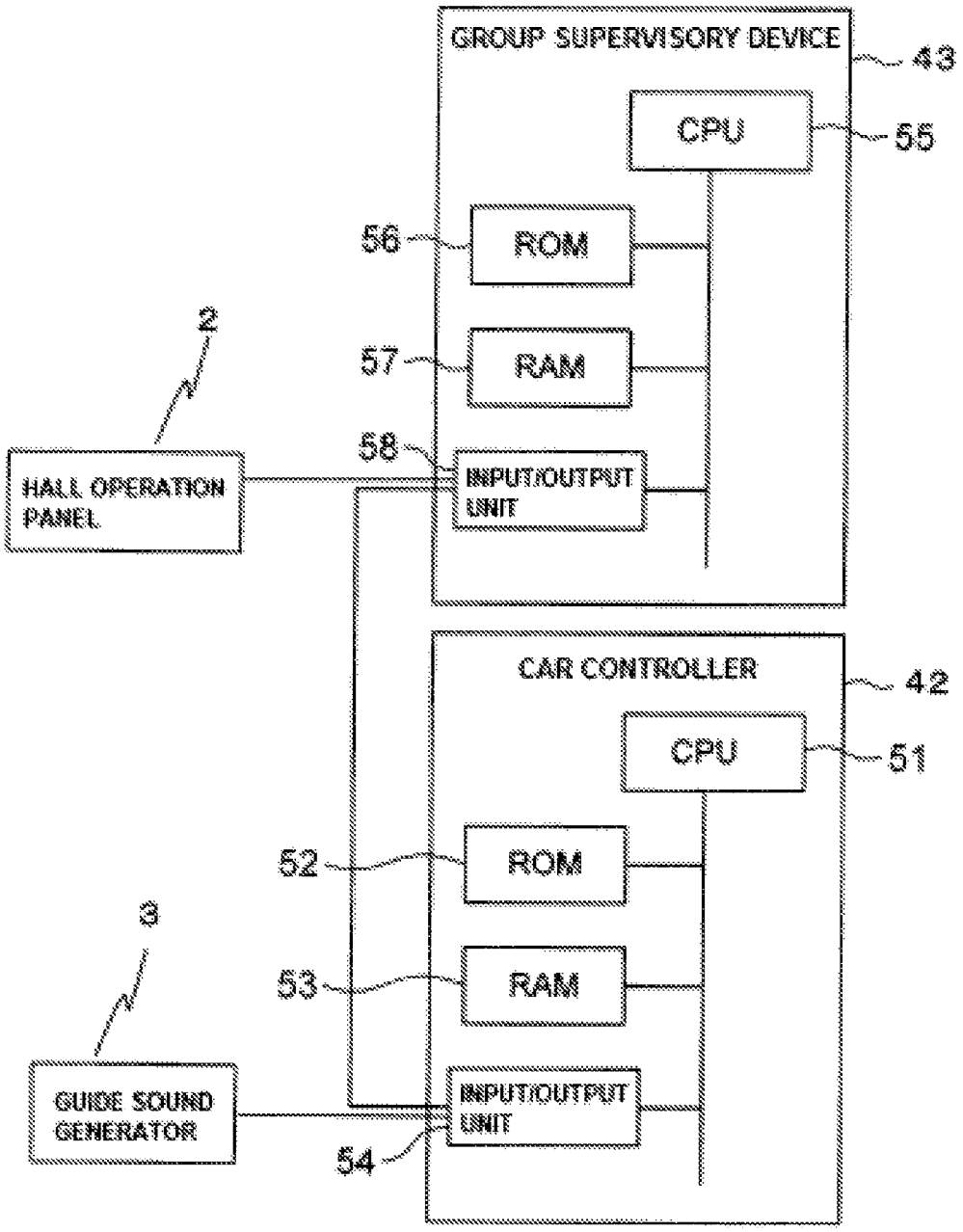
FIG. 5 is a diagram for illustrating a hardware configuration of the elevator landing guidance device according to the first embodiment of the present invention.

Next, a hardware configuration of the elevator landing guidance device according to the first embodiment of the present invention is described. FIG. 5 is a block diagram for illustrating a hardware configuration of the elevator landing guidance device according to the first embodiment. The elevator landing guidance device according to the first embodiment includes the hall operation panels 2, the guide sound generators 3, the group supervisory device 43, and the car controller 42.

The car controller 42 includes a CPU 51, a ROM 52, a RAM 53, and an input/output unit 54. The input/output unit 54 includes a transmitting/receiving device. In the ROM 52, programs for achieving functions of the car controller 42 are stored. The CPU 51 reads out and executes the program stored in the ROM 52 to achieve the functions of each of the units of the car controller 42.

The car controller 43 includes a CPU 55, a ROM 56, a RAM 57, and an input/output unit 58. The input/output unit 58 includes a transmitting/receiving device. In the ROM 56, programs for achieving functions of the group supervisory device 43 are stored. The CPU 55 reads out and executes the program stored in the ROM 56 to achieve the functions of each of the units of the group supervisory device 43.

The hall operation panel 2 includes a panel for forming the operation panel and a dedicated processing circuit, which are configured to receive the landing call registration request, and a speaker and a dedicated processing circuit, which are configured to generate the guide sound A.

The guide sound generator 3 includes a speaker and a dedicated processing circuit, which are configured to generate the guide sound B.

Next, an operation of the elevator landing guidance device according to the first embodiment is described with reference to FIG. 1 to FIG. 3.

FIG. 1 is an illustration of an example in which a certain user inputs a destination floor with use of the hall operation panel 2 to make a landing call registration request and the group supervisory device 43 assigns the machine B to the landing call registration request. The example of FIG. 1 is described below. Further, in FIG. 2, "GUIDE SOUND A" in part for "HALL OPERATION PANEL 2" indicates an output timing of the guide sound A from the hall operation panel 2, "HOP OPERATION" indicates an operation performed by the user on the hall operation panel 2, and "ASSIGNMENT" indicates assignment processing of the elevator machine to landing call registration, which is performed by the group supervisory device 43. Further, "GUIDE SOUND B" in part for "GUIDE SOUND GENERATOR 3" of FIG. 2 indicates an output timing of the guide sound B from the guide sound generator 3.

As illustrated in FIG. 3, the group supervisory device 43 controls the hall operation panel 2 to output the guide sound A so as to inform the user of the position of the hall operation panel 2 (Step S1). The guide sound A is periodically output at predetermined intervals, as shown in FIG. 2.

The user is guided with the guide sound A to reach the position where the hall operation panel 2 is installed. The user operates the hall operation panel 2 to input a destination floor so as to request the landing call registration. When the group supervisory device 43 detects that the hall operation panel 2 has been operated, the group supervisory device 43 outputs a stop command for stopping the guide sound A to the hall operation panel 2 (Step S2). Further, the group supervisory device 43 performs processing for the landing call registration in accordance with the landing call registration request made by the user. Further, the group supervisory device 43 assigns an appropriate elevator machine to the landing call registration, and outputs an assignment signal. The assignment signal output from the group supervisory device 43 is transmitted to the car controller 42 corresponding to the assigned elevator machine 4.

Next, after the transmission of the assignment signal, the group supervisory device 43 issues a command for restarting the output of the guide sound A to the hall operation panel 2. The hall operation panel 2 outputs the guide sound A in accordance with the command (Step S3). With the guide sound A, other subsequent users can be informed of the position of the hall operation panel 2.

After the reception of the assignment signal from the group supervisory device 43, the car controller 42 controls the guide sound generator 3 to output the guide sound B so as to inform the user of the position of the landing for the assigned elevator machine 4 (Step S4). The guide sound generator 3 is installed for each of the elevator machines 4 as described above, and outputs the guide sound B toward the landing for the corresponding elevator machine 4.

Next, with the control of the car controller 42, the assigned elevator machine 4 runs to and stops at the destination floor. After a door of the assigned elevator machine 4 is opened, the car controller 42 stops the output of the guide sound B from the guide sound generator 3 (Step S5). The output of the guide sound B may be stopped not after the door of the elevator machine 4 is opened but after the door of the elevator machine 4 is closed.

As described above, in the first embodiment, the user of the elevator is informed of the position of the hall operation panel 2 with use of auditory information, which is the guide sound A. As a result, even when the user of the elevator is a visually impaired person, the user is guided with the guide sound A so as to be able to smoothly arrive at the position of the hall operation panel 2.

Further, in the first embodiment, the user of the elevator is informed of the position of the landing for the elevator machine corresponding to the landing call registration requested to be registered by the user with use of auditory information, which is the guide sound B. As a result, even when the user of the elevator is a visually impaired person, the user is guided with the guide sound B so as to be able to smoothly arrive at the position of the landing for the corresponding elevator machine.

Further, in the first embodiment, only when the landing call registration is performed, the guide sound B is output only in the landing for the elevator machine 4 assigned to the landing call registration. In this manner, by limiting the timing of outputting the guide sound B, the user easily recognizes the guide with use of the guide sound B.

Further, in the first embodiment, as illustrated in FIG. 1, the hall operation panel 2 is installed so as to be separate from the machine A by a preset distance. As a result, a possibility that a user who is looking for the installation position of the hall operation panel 2 may come into contact with another user waiting for arrival of the machine A can be reduced.

Further, in the first embodiment, as illustrated in FIG. 1, the machine B is installed on a far side of the machine A. Thus, a user B who is to board the machine B is required to move so as to avoid a user A who is waiting for the arrival of the machine A. As a result, there arises a risk that the user B may lose the position of the landing for the machine B while moving. Thus, in the related art, the elevator machine to be assigned to visually impaired people is only the machine A, which is the closest to the hall operation panel 2. Meanwhile, in the first embodiment, the guide sound B is output in the landing for the machine B. As a result, there is no risk that the user B may lose the position of the landing for the machine B while moving. Thus, in the first embodiment, even when the user is a visually impaired person, any one of the machines B to F other than the machine A may be assigned. Thus, travel efficiency of a whole elevator system can be increased.

In the first embodiment, the guide sound B may be output only when a travel mode of the elevator is a preset specific mode. In this case, the guide sound B may also be output only when a specific user uses the elevator. In this case, a frequency of the output of the guide sound B is decreased, and hence mixture of sound in the landing can be reduced. As examples of the preset specific mode, for example, a visually impaired person mode, and other language user mode are given. The user who needs to switch to a specific mode operates a mode switching button provided to the hall operation panel 2 to perform switching to the specific mode.

Second Embodiment

In a second embodiment, as each of the guide sound A and the guide sound B, which have been described in the first embodiment, a sign sound is used. The term "sign sound" herein means an artificial sound to be used for the purpose of providing some kind of information to the user. In general, the sign sound is used as, for example, an operation confirmation sound for a consumer product such as a home electric appliance, a train arrival and departure sound in a public space such as on a station platform.

In the second embodiment, the sign sound to be used as the guide sound A and the sign sound to be used as the guide sound B may be set to the same kind of sign sound. However, the guide sound A and the guide sound B may be set to different kinds of sign sounds. The sign sound is less liable to be mixed with a voice of a user in terms of characteristics, and thus is easy for the user to hear and distinguish. As a result, even in a case in which the guide sound A and the guide sound B are each generated at a small volume when the landing is crowded, the user can easily distinguish the guide sound A and the guide sound B from each other. Thus, an unpleasant feeling of the user due to difficulty in hearing and distinguishing can be reduced. Further, in contrast to a verbal speech, the sign sound can be commonly used throughout the world. Other configurations and operations are the same as those of the first embodiment described above, and thus the description thereof is herein omitted.

As described above, in the second embodiment, the sign sound is used as each of the guide sound A and the guide sound B. Thus, the user can easily perceive the guide sound A and the guide sound B, and can use common guide sounds for users of all languages.

Third Embodiment

In a third embodiment, description is made of a case in which an output period of the guide sound A and an output period of the guide sound B in the second embodiment described above are set so as to be different from each other. Specifically, the output period of the guide sound A is set to T1 seconds. With the setting, the guide sound A is periodically output every T1 seconds. Meanwhile, the output period of the guide sound B is set to T2 seconds. In this case, a value of the T2 is different from a value of the T1. With the setting, the guide sound B is periodically output every T2 seconds. As described above, by setting the output period T1 of the guide sound A and the output period T2 of the guide sound B to different values, a frequency of simultaneous output of the guide sound A and the guide sound B can be reduced. Thus, mixture of the guide sound A and the guide sound B can be reduced. Further, it is more desirable that the guide sound A and the guide sound B be set to different kinds of sounds in case that the guide sound A and the guide sound B are simultaneously output. Other configurations and operations are the same as those of the first embodiment and the second embodiment, and thus the description thereof is herein omitted.

In the third embodiment, the output period T1 of the guide sound A and the output period T2 of the guide sound B are set so as to be different from each other. Thus, a frequency of the simultaneous output of the guide sound A and the guide sound B is low. Further, even when the guide sound A and the guide sound B are simultaneously output, at least a timing at which the guide sound A and the guide sound B are not simultaneously output can be set. Thus, the user can easily hear and distinguish the guide sounds.

Fourth Embodiment

Figure 6:
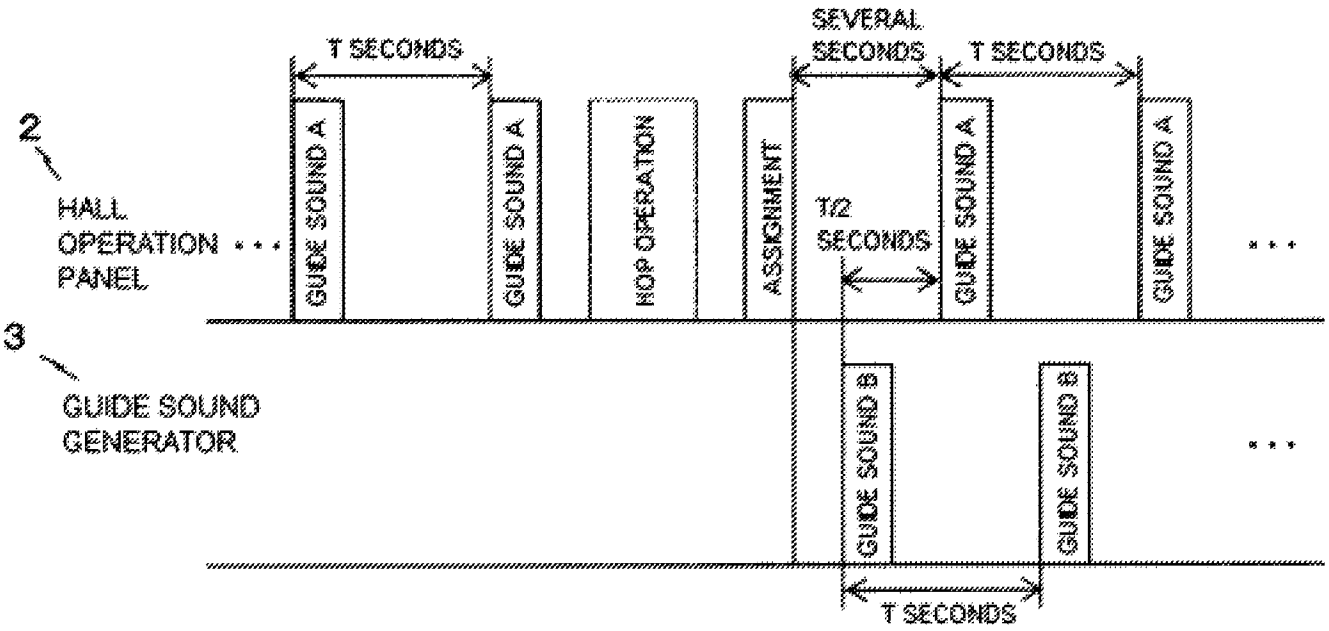
FIG. 6 is a timing chart for showing output timings of the guide sound A and the guide sound B in an elevator landing guidance device according to a fourth embodiment of the present invention.

In a fourth embodiment, in contrast to the third embodiment described above, description is made of a case in which the output period T1 of the guide sound A and the output period T2 of the guide sound B in the second embodiment are set so as to be the same. However, any one of a start timing of the output period T1 of the guide sound A and a start timing of the output period T2 of the guide sound B is shifted by a given time period so that the start timings do not match with each other. With the shift described above, the guide sound A and the guide sound B are not simultaneously output. In particular, as shown in FIG. 6, it is desired that a shift amount of the start timing be set to a half of the output period. Specifically, as shown in FIG. 6, the output period of the guide sound A and the output period of the guide sound B are both set to T seconds. At this time, the start timing of the guide sound A is shifted from the start timing of the guide sound B by T/2 seconds. In this case, the guide sound A and the guide sound B are alternately output, and thus are not simultaneously output. As a result, when the user moves from the hall operation panel 2 to the landing for the elevator machine 4 assigned to the user, the user can easily obtain a positional relationship between an actual location of the user and a destination. Other configurations and operations are the same as those of the first embodiment and the second embodiment, and thus the description thereof is herein omitted.

As described above, in the fourth embodiment, the output period of the guide sound A and the output period of the guide sound B are set to the same period, and the start timing of the output period of the guide sound A and the start timing of the output period of the guide sound B are set so as to be different from each other. Thus, the guide sound A and the guide sound B are not simultaneously output, and hence are easy for the user to hear and distinguish.

Fifth Embodiment

In a fifth embodiment, as the guide sound B generated from the guide sound generator 3, an audio message is used. Specifically, as the guide sound B, an audio message, for example, "USE MACHINE B" is generated from the guide sound generator 3. Alternatively, the guide sound B is generated as a combination of a guide sound such as a sign sound and an audio message. In this manner, the user easily understands a purpose of output of the guide sound B. With the output of the guide sound B containing a name of an elevator machine assigned to the landing call registration, the user can simultaneously understand the elevator machine name and a position of the landing for the elevator machine, which corresponds to the elevator machine name. In the fifth embodiment, a sign sound is used as the guide sound A. Other configurations and operations are the same as those of any one of the first embodiment to the fourth embodiment, and thus the description thereof is herein omitted.

As described above, in the fifth embodiment, the audio message is used as the guide sound B generated from the guide sound generator 3. As described above, the audio message is used as the guide sound B, and hence the user can easily understand the purpose of output of the guide sound B. Further, the user can simultaneously understand the elevator machine name and the position of the landing for the elevator machine, which corresponds to the elevator machine name.

In the first to fifth embodiments described above, the hall operation panel 2 is operated by the control of the group supervisory device 43. However, the operation of the hall operation panel 2 is not limited thereto. Specifically, a CPU is provided in the hall operation panel 2. By control of the CPU, the hall operation panel 2 may start and stop the output of the guide sound A. In this case, when an operation is input by the user, the hall operation panel 2 stops the output of the guide sound A and, after elapse of a predetermined time period, restarts the output of the guide sound A.

In the first to fifth embodiments described above, the guide sounds B to be output from the guide sound generator 3 may be set as sounds different for the elevator machines. In this case, the sounds are changed so as to be different from each other for the elevator machines by changing an output pattern of outputting the sign sound or adjusting an amplitude or a frequency of the sound. In general, a sound volume can be increased by increasing the amplitude of the sound, and a sound pitch can be raised by increasing the frequency of the sound. Thus, for example, by increasing the frequency and the amplitude of the guide sound B to be output from the guide sound generator 3 as a distance of the installation position of the elevator machine from the hall operation panel 2 is increased, the output sound B output in the landing far from the user can be easily heard and distinguished by the user who is present in proximity to the hall operation panel 2. More specifically, the amplitudes and the frequencies of the guide sounds B are set so that the guide sound B in the landing for the machine B and the machine E has a larger volume and a higher pitch than the guide sound B in the landing for the machine A and the machine D. Further, the amplitudes and the frequencies of the guide sounds B are set so that the guide sound B in the landing for the machine C and the machine F has a larger volume and a higher pitch than the guide sound B in the landing for the machine B and the machine E. Further, in comparison between the machine A and the machine D, the amplitudes and the frequencies are set so that the guide sound B for the machine D has a larger volume and a higher pitch than the guide sound B for the machine A. Similarly, in comparison between the machine B and the machine E, the amplitudes and the frequencies are set so that the guide sound B for the machine E has a larger volume and a higher pitch than the guide sound B for the machine B. Similarly, in comparison between the machine C and the machine F, the amplitudes and the frequencies are set so that the guide sound B for the machine F has a larger volume and a higher pitch than the guide sound B for the machine C. As described above, the frequencies and the amplitudes may be suitably set so that the volume of the guide sound B to be output from the guide sound generator 3 is increased and the pitch of the guide sound B is raised as the distance of the installation position of the elevator machine from the hall operation panel 2 is increased.

REFERENCE SIGNS LIST

1 landing, 2 hall operation panel, 3 guide sound generator, 4 elevator machine, 42 car controller, 43 group supervisory device

The invention claimed is:

1. An elevator landing guidance device, comprising:

a hall operation panel, which is provided on each of floors, and which is configured to accept input of landing call registration; and a guide sound generator, which is provided to a landing of each of the floors for each of elevator machines, and is configured to output a first guide sound for informing a position of the landing of each of the floors for each of the elevator machines, wherein, when the landing call registration is input to the hall operation panel and before an assigned one of the elevator machines reaches the corresponding floor, the guide sound generator corresponding to the assigned one of the elevator machines, which is assigned to the landing call registration, outputs the first guide sound.

2. The elevator landing guidance device according to claim 1, wherein the first guide sound comprises a sign sound.

3. The elevator landing guidance device according to claim 1, wherein the first guide sound comprises an audio message and a combination of an audio message and a sign sound.

4. The elevator landing guidance device according to claim 1, wherein the hall operation panel is configured to output a second guide sound for informing an installation position of the hall operation panel, wherein, when the hall operation panel accepts the input of the landing call registration while outputting the second guide sound, the hail operation panel temporarily stops the output of the second guide sound, and, when a preset condition is met, the hall operation panel restarts the output of the second guide sound.

5. The elevator landing guidance device according to claim 4, wherein the second guide sound comprises a sign sound.

6. The elevator landing guidance device according to claim 4, wherein the first guide sound is repeatedly output in a preset first period, and wherein the second guide sound is repeatedly output in a preset second period different from the first period.

7. The elevator landing guidance device according to claim 4, wherein the first guide sound is started to be output at a preset first start timing, and is repeatedly output in a preset first period, wherein the second guide sound is started to be output at a preset second start timing, and is repeatedly output in the first period, and wherein the first start timing is shifted from the second start timing by a preset shift amount.

8. An elevator comprising the elevator landing guidance device of claim 1.

9. The elevator landing guidance device according to claim 1, wherein the hall operation panel is configured to output a second guide sound for informing an installation position of the hall operation panel.

10. An elevator landing guidance device, comprising:

a hall operation panel, which is provided on each of floors, and which is configured to accept input of landing call registration; and a guide sound generator, which is provided to a landing of each of the floors for each of elevator machines, and is configured to output a first guide sound for informing a position of the landing, wherein, when the landing call registration is input to the hall operation panel, the guide sound generator corresponding to one of the elevator machines, which is assigned to the landing call registration, outputs the first guide sound, wherein the hall operation panel is configured to output a second guide sound for informing an installation position of the hall operation panel, and wherein, when the hall operation panel accepts the input of the landing call registration while outputting the second guide sound, the hall operation panel temporarily stops the output of the second guide sound, and, when a, preset condition is met, the hall operation panel restarts the output of the second guide sound.

* * * * *